US012782067B2

(12) United States Patent
Allison et al.

(10) Patent No.: US 12,782,067 B2
(45) Date of Patent: Nov. 3, 2026

(54) THERMAL STRESS MANAGEMENT FOR HEAT EXCHANGERS, PRESSURE VESSELS, AND OTHER FLUID-CARRYING OR FLUID-CONTAINING STRUCTURES WITH HIGH TEMPERATURE TRANSIENTS

(71) Applicant: Southwest Research Institute, San Antonio, TX (US)

(72) Inventors: Timothy C. Allison, San Antonio, TX (US); Michael P. Marshall, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 677 days.

(21) Appl. No.: 17/532,644

(22) Filed: Nov. 22, 2021

(65) Prior Publication Data

US 2022/0163274 A1 May 26, 2022

Related U.S. Application Data

(60) Provisional application No. 63/116,873, filed on Nov. 22, 2020.

(51) Int. Cl.

| | |
|---|---|
| ***F28D 1/06*** | (2006.01) |
| ***F28F 3/12*** | (2006.01) |
| ***F28F 27/00*** | (2006.01) |

(52) U.S. Cl.
CPC ..... *F28F 27/00* (2013.01); *F28D 1/06* (2013.01); *F28F 3/12* (2013.01)

(58) Field of Classification Search
CPC ..... F28F 27/00; F28F 3/12; F28F 2265/10; F28F 2265/00; F28F 1/003; F28D 1/06
See application file for complete search history.

(56) References Cited

U.S. PATENT DOCUMENTS

2011/0308259 A1* 12/2011 Wray ..... F28F 13/06 165/104.11
2016/0305712 A1* 10/2016 Harris ..... F16L 59/123

FOREIGN PATENT DOCUMENTS

JP H1122893 A * 1/1999

* cited by examiner

*Primary Examiner* — Jianying C Atkisson
*Assistant Examiner* — Khaled Ahmed Ali Al Samiri
(74) *Attorney, Agent, or Firm* — Livingston Law Firm

(57) ABSTRACT

A method of managing transient thermal stresses in a wall of a fluid-carrying or fluid-containing structure, the structure having a temperature ramp rate limit associated with its structure walls. The structure is provided with flow passages in the structure walls, and the temperature of the structure walls is monitored. If a rate of change of temperature of the structure walls becomes too high, fluid is circulated through the flow passages to heat or cool the structure wall during hot or cold transient thermal events, respectively.

8 Claims, 3 Drawing Sheets

THERMAL STRESS MANAGEMENT FOR HEAT EXCHANGERS, PRESSURE VESSELS, AND OTHER FLUID-CARRYING OR FLUID-CONTAINING STRUCTURES WITH HIGH TEMPERATURE TRANSIENTS

PRIORITY CLAIM

This patent application claims the filing date benefit of U.S. provisional Patent Application No. 63/116,873, filed Nov. 22, 2020, entitled "Thermal Management for Heat Exchangers and Pressure Vessels.

TECHNICAL FIELD OF THE INVENTION

This invention relates to heat exchangers and other equipment that undergo rapid transients in process temperatures, and more particularly to thermal management for such equipment.

BACKGROUND OF THE INVENTION

Heat exchangers and pressure vessels in power generation, propulsion, petrochemical, or other applications are limited in their capability to accommodate rapid transients in process temperatures. Many of these fluid-carrying or fluid-containing structures have thick walls at pressure boundaries, which have a large thermal mass resistant to fast temperature changes.

In heat exchangers, fast process temperature changes impose high transient temperature gradients in the pressure boundary and other locations in the heat exchanger (e.g. joints, tube sheets, headers, and manifolds) resulting in high stresses and potentially causing thermal fatigue and mechanical failures. For example, a high-temperature carbon dioxide heater used for supercritical carbon dioxide (sCO2) power cycles has ramp rate limits of 100° F. per hour up to 500° F. and a ramp rate of 200° F. above that based upon the tube metal temperature.

Another example of an application with fast process temperature changes is in steam turbine boilers, valves, and casings. These components are ramp-rate limited due to transient stresses.

There is significant interest in developing heat exchangers for the sCO2 application at even higher pressures and temperatures, as well as for other applications. With existing designs, these heat exchangers operate close to material limits at steady-state and are likely to have ramp rate limits due to thick material sections at high pressure areas.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following invention is directed to methods for actively controlling temperature profiles during process temperature transients experienced by equipment such as heat exchangers and pressure vessels. These devices have high-stress regions in their walls during transient temperature operations. The method uses flow passages in the walls to circulate fluid to actively manage temperature gradients. This decreases time limits imposed on process transients.

This description provides two examples of structures with which the invention is useful—a heat exchanger and a pressure vessel. However, the invention is not limited to these two types of structures; it is useful for any structure that carries or contains fluids that have transient temperatures. As used herein, the term "structure" refers to such fluid-carrying or fluid-containing equipment.

Figure 1:
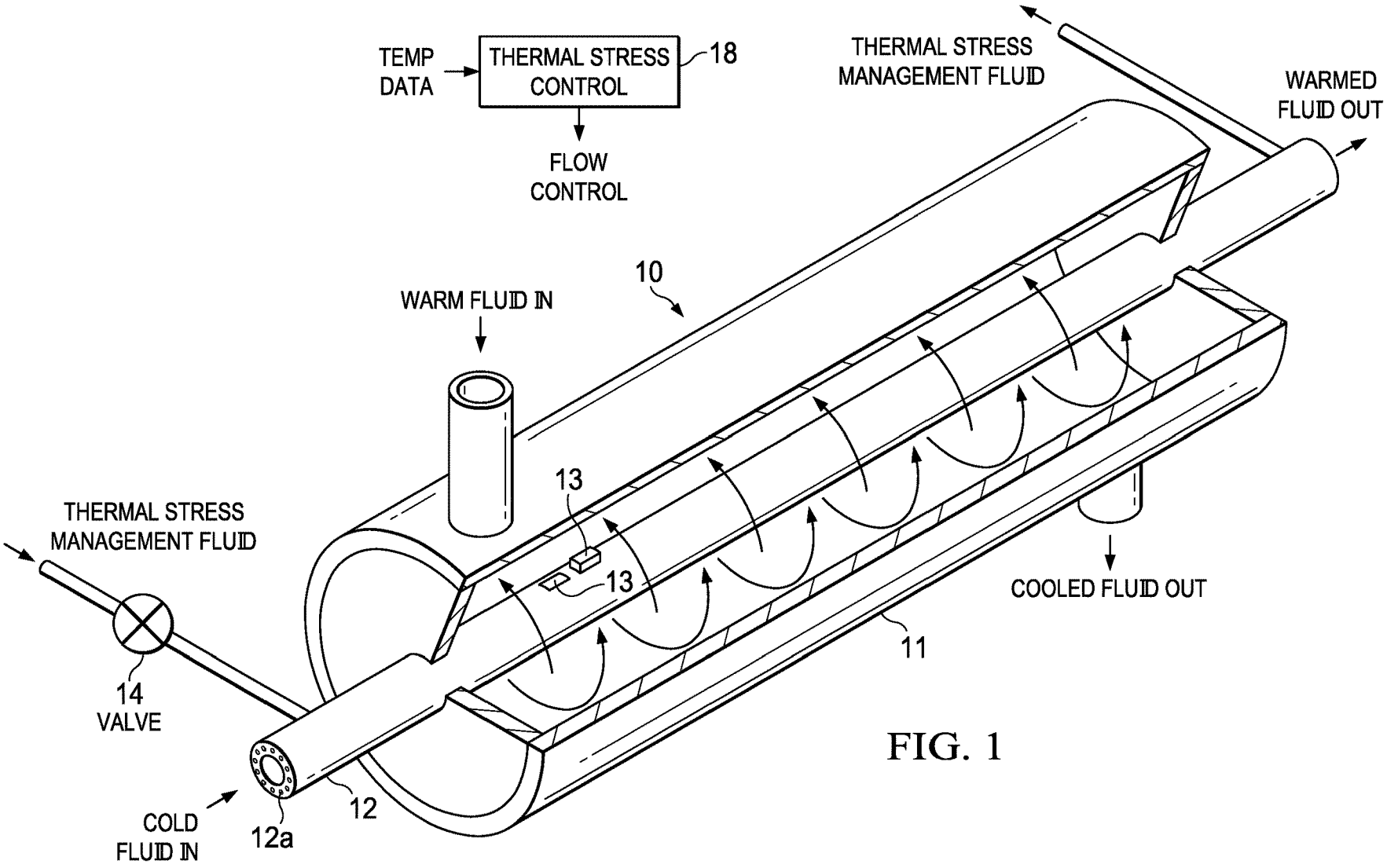
FIG. 1 illustrates a heat exchanger having flow passages in accordance with the invention.

FIG. 1 illustrates an example of a simple heat exchanger 10, that is, a device used to transfer heat between fluids. In the example of FIG. 1, warm fluid in an outer casing 11 is used to provide heat to a cool fluid in an inner tube 12. In accordance with the invention, the wall of tube 12 has flow passages 12*a*. In this example, the flow passages 12*a* run axially along tube 12. During temperature transients, liquid is circulated through these passages 12*a*, as described below in connection with FIG. 3.

Figure 2:
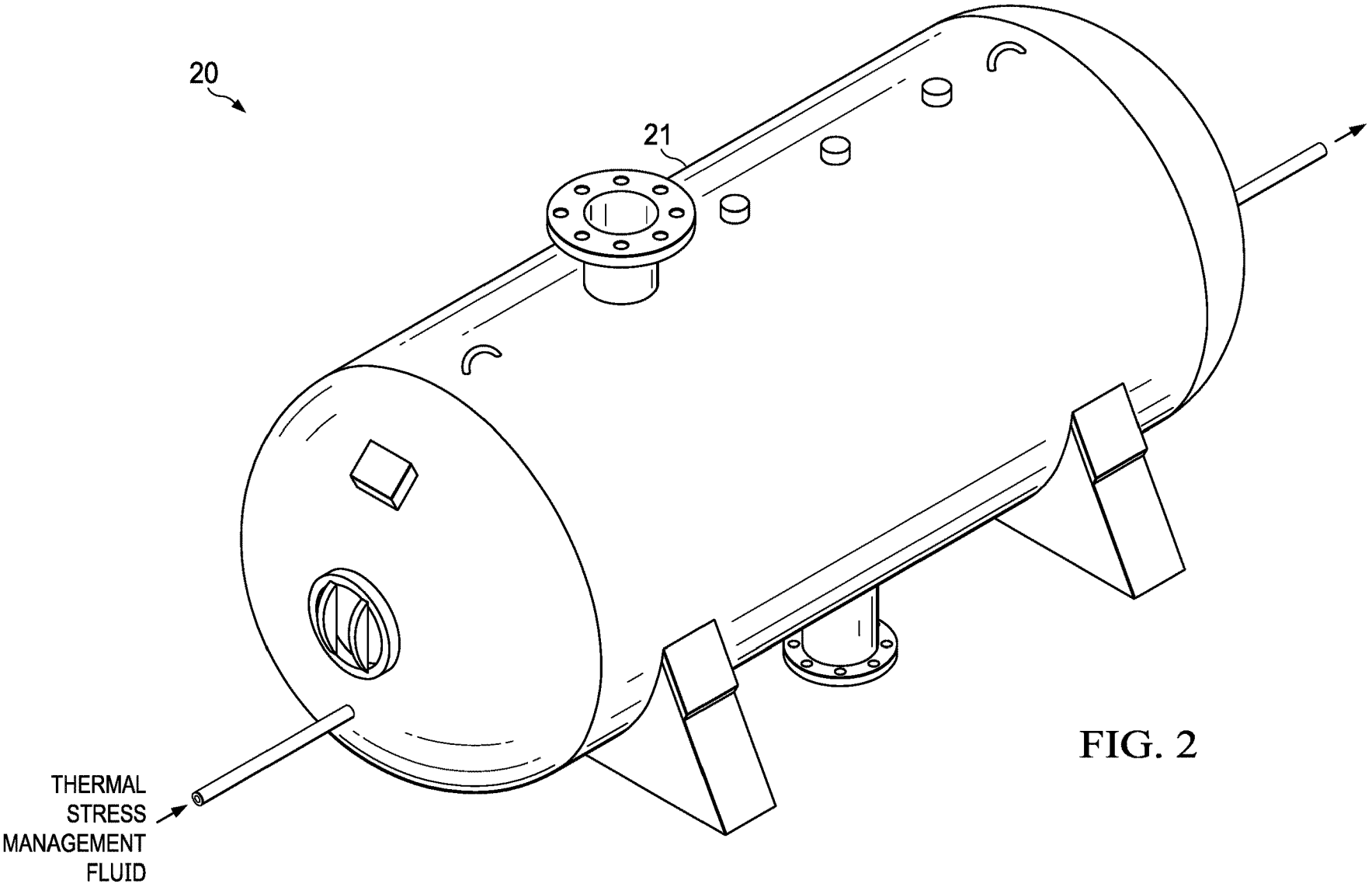
FIG. 2 illustrates a pressure vessel having walls with flow passages in accordance with the invention.

FIG. 2 illustrates an example of a pressure vessel 20, that is, a container designed to hold gases or liquids at a pressure substantially different from the ambient pressure. Pressure vessels are used in a variety of applications in both industry and the private sector. Examples are compressed air receivers and storage vessels for liquified gases such as ammonia, chlorine, and LPG (propane, butane). Often, the application requires large temperature transients of fluid contained in the vessel.

Pressure vessel 20 has inlet and outlet nozzles for a process fluid. Process fluid temperature changes increase thermal stresses in the structure, which calls flow passages in the walls of the structure and for thermal stress management fluid circulating in the flow passages.

Thus, like heat exchanger 10, pressure vessel 20 has walls 21 having flow passages for managing transient temperature changes, using the method described herein. In the case of pressure vessel 20, the structure walls 21 are the outer containing walls of the vessel.

Figure 3:
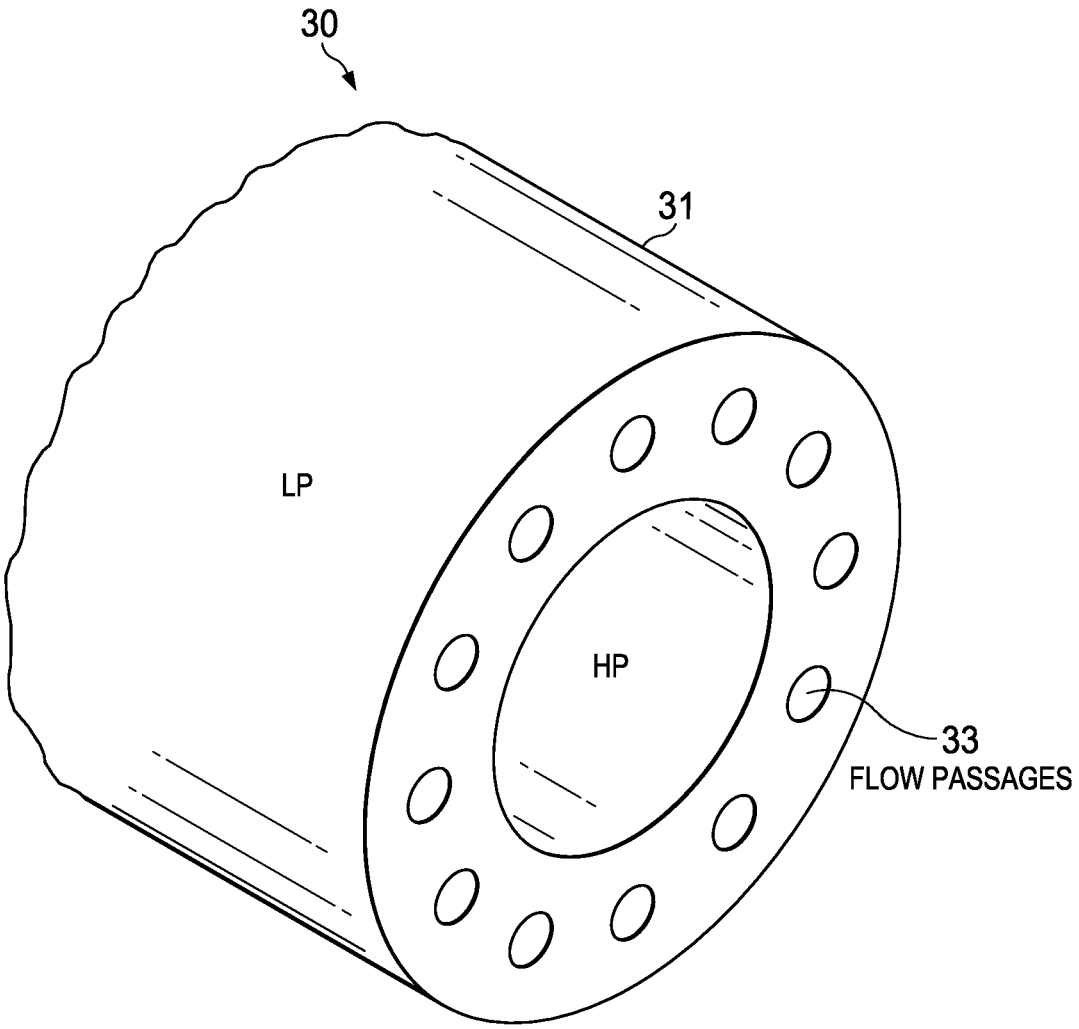
FIG. 3 illustrates flow passages in a portion of a tube wall, such as in the heat exchanger of FIG. 1.

FIG. 3 is a cross-sectional view of a segment of a wall 31 of a tube 30. In the example of FIG. 3, wall 31 is a cylindrical tubing-type wall like that of the heat exchanger of FIG. 1. However, wall 31 is representative of any structure wall that undergoes high temperature transients.

Wall 31 has flow passages 33 that circulate high-temperature or low-temperature fluid during transient heating or cooling events, respectively. The flow passages may be in any or all portions of a wall of the structure.

In this example, during steady-state operation, the tube 30 contains a high-pressure (HP) fluid inside its bore that transfers heat to or from the low-pressure (LP) fluid outside the tube 30. During fast temperature transients in the LP or HP process streams, sharp radial temperature gradients will set up across the tube wall, increasing thermal stresses.

The small flow passages 33 integrated into the tube wall are supplied with hot or cold fluid during transients to manage the temperature gradient in way that minimizes transient thermal stresses, thus increasing the ramp rate capabilities of the heat exchanger. The fluid circulated through the flow passages 33 is high-temperature during a heating event or low-temperature during a cooling event.

In the example of FIG. 3, the flow passages 33 are arranged so that the cooling or heating fluid flows parallel to the fluid flow in tube 30. However, many other geometries for the flow passages are possible. For example, as the flow passages may be arranged circumferentially around a tube. In general, the flow passages may have any sort of pattern within the structure wall.

Various modeling and other analysis may be made for a particular structure to determine where cooling or heating of the structure walls is most needed, with the flow passages being specifically patterned to provide cooling or heating in those areas. The transient flow passages may include complex geometry features to enhance heat transfer and/or target specific regions of high thermal stress inside the structure.

Although the example of FIG. 3 shows transient flow passages integrated into a tube wall, flow passages can be integrated into other structures and components of structures. These passage locations can be at any pressure boundary or internal/external joint that undergoes high transient thermal stresses. The design and location of the flow passages may represent a compromise design between transient ramp rate capability and steady-state heat transfer performance.

Referring again to FIG. 1, in the heat exchanger example, the fluid supplied to flow passages 12*a* is the same process fluid supplied to the heat exchanger. A diversion line may be used to divert a portion of the process fluid to the flow passages. However, in other embodiments, such as the embodiment of FIG. 2, the fluid supplied to the flow passages may from a different source and may be a different fluid altogether.

In accordance with the method of the invention, and referring to the example of FIG. 1, for transient temperature management of the structure walls, fluid is supplied into flow passages 12*a* for heating or cooling (as appropriate for the application).

A thermal stress control process 18 receives input data representing the temperature of the structure wall of interest. This temperature monitoring input data may represent the structure wall temperature directly or indirectly. In other words, the temperature input data may come from direct temperature measurement, using one or more sensors 13 as illustrated in FIG. 1.

Sensor(s) may be used on the outer and/or inner surface of the structure wall to obtain a temperature gradient. Alternatively, the temperature input data could be data representing the temperature of the process fluid or the temperature of the fluid used in the passages. From the input data, process 18 determines or estimates whether the ramp rate of the structure wall is exceeded. Process 18 may store and compare current ramp rates to a threshold to determine if heating or cooling of the structure wall is called for.

The circulation of fluid through the flow passages is initiated and controlled based on temperature values and measured rates of change of the structure temperature or the process fluid temperature. A more enhanced control process could include predicting temperature changes so that heating and cooling could be provided preemptively. This could be accomplished with data representing expected changes to the process flow temperature such as during startups and shutdowns.

The fluid supplied to flow passages for thermal management may be at the same operating conditions (pressure and temperature) as one of the process streams. Alternatively, the fluid may be at different operating conditions.

Thermal stress control process 18 has appropriate hardware and software for performing the tasks described herein. Process 18 may be part of a larger more comprehensive control system for the equipment.

The fluid supplied to transient flow passages may be supplied only during transients, or it may also be supplied during steady-state operation. In the example of FIG. 1, process 18 controls a valve 14 for controlling the flow of fluid into the flow passages when desired.

A feature of the invention is that the flow passages may be made part of the structure walls through additive manufacturing of the structure. This allows complex flow passage geometries to provide heating or cooling exactly where needed. Additive manufacturing of flow passages will enable heating or cooling in areas that could not be reached with conventional machining methods, which allows for more effective thermal management of transient thermal stresses. Alternatively, the flow passages may be manufactured subtractively through more conventional methods.

As stated above, the invention is not limited to the shell and tube heat exchanger example of FIG. 1 or the conventional pressure vessel example of FIG. 2. There are many other structure geometries for heat exchangers and/or pressure vessels that are non-tubular. A heat exchanger could have a plate-frame or tube-dimple geometry, where the internal structures are flat plates. These may be pressure-containing or the internal structures may be inside a separate pressure-containing structure that is a large box, cylinder, etc. Another type of heat exchanger is a printed circuit heat exchangers, which again may have flat-plate internal structures in a box-type pressure vessel. There are many other types of geometries, too—helical plates, wavy sheets, 3D geometries, etc. Any of these geometries could benefit from this invention, either with passages in the wall of an outer pressure-containing structure (if it exists) or in the internal structures.

What is claimed is:

1. A method of managing transient thermal stresses in a structure that carries or contains a process fluid, comprising:

identifying pressure boundaries of the structure that are susceptible to failure as a result of rapid temperature changes, thereby identifying pressure boundaries having a ramp rate threshold;

storing the temperature ramp rate threshold;

providing flow passages in the structure walls at the pressure boundaries;

measuring, directly or indirectly, the temperature of the structure walls at or near the pressure boundaries, thereby obtaining temperature measurements;

calculating a rate of change in temperature, based on the temperature measurements;

determining whether the rate of change of temperature exceeds or will exceed the temperature ramp rate threshold;

if the temperature ramp rate threshold is exceeded or will be exceeded, circulating a heating or cooling (heating/cooling) fluid through the flow passages;

determining a pressure and temperature at which to circulate the heating/cooling fluid;

wherein the heating/cooling fluid serves to heat or cool the pressure boundaries during hot or cold transient thermal events, respectively.

2. The method of claim 1, wherein the providing step is performed by manufacturing the structure walls with the flow passages in an additive manufacturing process.

3. The method of claim 1, wherein the structure is tubular and the flow passages are arranged axially within the structure walls.

4. The method of claim 1, wherein the heating/cooling fluid is a heating fluid during a heating event of the structure.

5. The method of claim 1, wherein the heating/cooling fluid is cooling fluid during a cooling event of the structure.

6. The method of claim 1, wherein the structure is one or more tubular components of a heat exchanger.

7. The method of claim 1, wherein the structure is a wall of a pressure vessel.

8. The method of claim 1, wherein the heating/cooling fluid is at a different temperature or pressure as the process fluid.

* * * * *